US010115283B1

(12) United States Patent
Sokolov et al.

(10) Patent No.: US 10,115,283 B1
(45) Date of Patent: Oct. 30, 2018

(54) SYSTEMS AND METHODS FOR PROVIDING ASSISTANCE TO USERS IN EMERGENCY SITUATIONS

(71) Applicant: Symantec Corporation, Mountain View, CA (US)

(72) Inventors: Ilya Sokolov, Boston, MA (US); Keith Newstadt, Newton, MA (US)

(73) Assignee: Symantec Corporation, Mountain View, CA (US)

( * ) Notice: Subject to any disclaimer, the term of this patent is extended or adjusted under 35 U.S.C. 154(b) by 0 days.

(21) Appl. No.: 15/458,061

(22) Filed: Mar. 14, 2017

(51) Int. Cl.
*G08B 1/08* (2006.01)
*G08B 21/04* (2006.01)
*G08B 27/00* (2006.01)

(52) U.S. Cl.
CPC ..... *G08B 21/0453* (2013.01); *G08B 27/00* (2013.01)

(58) Field of Classification Search
CPC ..... G08B 21/0453
USPC ..... 340/539.12
See application file for complete search history.

(56) References Cited

U.S. PATENT DOCUMENTS 6,201,476 B1 * 3/2001 Depeursinge ..... A61B 5/1117 340/529
2006/0226974 A1 * 10/2006 Fluegel ..... G08B 21/0211 340/539.12
2012/0295575 A1 * 11/2012 Nam ..... G08B 25/016 455/404.1
2014/0155017 A1 * 6/2014 Fan ..... H04W 4/02 455/404.1
2014/0162698 A1 * 6/2014 Han ..... H04W 4/00 455/456.3
2014/0333412 A1 * 11/2014 Lewis ..... G07C 9/00031 340/5.2
2015/0302539 A1 * 10/2015 Mazar ..... G08B 21/0211 705/3
2016/0050037 A1 * 2/2016 Webb ..... H04B 5/0025 455/3.01
2017/0251360 A1 * 8/2017 Adamo, Jr. ..... H04W 8/22
(Continued)

OTHER PUBLICATIONS

Medical Grade Devices; https://www.forbes.com/sites/jenniferhicks/2016/04/30/are-medical-grade-devices-the-next-generation-of-wearables/#2843017b62bb; Apr. 30, 2016; as accessed on Mar. 6, 2017.

(Continued)

*Primary Examiner* — Santiago Garcia
(74) *Attorney, Agent, or Firm* — FisherBroyles, LLP

(57) ABSTRACT

The disclosed computer-implemented method for providing assistance to users in emergency situations may include (i) detecting that a user of an endpoint device is involved in an emergency situation, (ii) identifying an individual capable of assisting the user in the emergency situation by (a) locating an additional endpoint device that is nearby the endpoint device of the user and (b) determining that the additional endpoint device asserts an attribute of the individual that indicates the individual is qualified to assist the user involved in the emergency situation and is verified by a trusted third party, and (iii) enabling the individual to assist the user involved in the emergency situation by providing information about the emergency situation from the endpoint device of the user to the additional endpoint device. Various other methods, systems, and computer-readable media are also disclosed.

20 Claims, 8 Drawing Sheets

(56) References Cited

U.S. PATENT DOCUMENTS

2017/0270613 A1* 9/2017 Scott ..... G06Q 40/08

OTHER PUBLICATIONS

ShoCard; https://shocard.com/; Mar. 2, 2001; as accessed on Mar. 6, 2017.
Smart Watches; http://smartwatches.org/learn/best-senior-wearables-gps-trackers/; Jul. 31, 2015; as accessed on Mar. 6, 2017.
Medical ID; https://9to5mac.com/2014/09/21/medical-id-ios8/; Sep. 21, 2017; as accessed on Mar. 6, 2017.

* cited by examiner

Table of Individuals Qualified to Assist in Emergency Situations
402

| TYPE OF EMERGENCY | PRIORITY 1 | PRIORITY 2 | PRIORITY 3 | PRIORITY 4 |
|---|---|---|---|---|
| Medical | Doctor | Medical Student | Certified Individual | Connect User to 911 |
| Public Safety | Police Officer | Security Guard | Connect User to 911 | |
| Family | Child Services Worker | Connect User to 911 | | |

*FIG. 4*

SYSTEMS AND METHODS FOR PROVIDING ASSISTANCE TO USERS IN EMERGENCY SITUATIONS

BACKGROUND

When experiencing or witnessing emergencies such as severe health problems, crimes, and natural disasters, individuals may often contact emergency response agencies to request assistance. For example, in the event of a robbery or assault, an individual may dial 911 to request aid from local police officers. In another example, a wearable medical device may contact a dispatch service to request an ambulance or other medical assistance in response to detecting a dangerous change in a user's health.

Unfortunately, these traditional methods for requesting assistance in emergency situations may be slow and/or ineffective. For example, the health level of an individual experiencing an acute medical crisis may severely deteriorate while the individual waits for an ambulance to arrive. In addition, some individuals may be hesitant to request assistance from an emergency response agency. For example, an individual may underestimate the severity of an emergency and decline to report the emergency, even if the situation warrants immediate assistance. On the other hand, individuals that falsely or incorrectly report emergencies may consume the limited time and resources available to emergency response agencies. The instant disclosure, therefore, identifies and addresses a need for systems and methods for providing assistance to users in emergency situations.

SUMMARY

As will be described in greater detail below, the instant disclosure describes various systems and methods for providing assistance to users in emergency situations. In one example, a method for providing assistance to users in emergency situations may include (i) detecting that a user of an endpoint device is involved in an emergency situation, (ii) identifying an individual capable of assisting the user in the emergency situation by (a) locating an additional endpoint device that is nearby the endpoint device of the user and (b) determining that the additional endpoint device asserts an attribute of the individual that indicates the individual is qualified to assist the user involved in the emergency situation and is verified by a trusted third party, and (iii) enabling the individual to assist the user involved in the emergency situation by providing information about the emergency situation from the endpoint device of the user to the additional endpoint device.

In some examples, the attribute of the individual may indicate an educational degree and/or certification of the individual. Additionally or alternatively, the attribute of the individual may indicate the individual's occupation.

In some embodiments, detecting that the user of the endpoint device is involved in the emergency situation may include determining that the user is experiencing a medical emergency based on biological sensors within the endpoint device that monitor a health level of the user.

In some examples, identifying the individual capable of assisting the user in the emergency situation may include (i) identifying multiple individuals capable of assisting the user in the emergency situation and then (ii) selecting an individual most qualified to assist the user in the emergency situation based on a comparison between attributes of the multiple individuals that indicate the individuals are qualified to assist the user. Additionally, in some embodiments, identifying the individual capable of assisting the user may include (i) broadcasting a request for assistance to all endpoint devices nearby the endpoint device of the user and then (ii) receiving, from the additional endpoint device in response to the request, the attribute of the individual that indicates the individual is qualified to assist the user. In other embodiments, identifying the individual capable of assisting the user may include determining that the additional endpoint device broadcasts the attribute of the individual prior to receiving a communication from the endpoint device of the user.

In some examples, locating the additional endpoint device that is nearby the endpoint device of the user may include determining that the additional endpoint device is located within a predetermined geographic distance from the endpoint device of the user. Additionally or alternatively, locating the additional endpoint device may include identifying the additional endpoint device using a short-range communication protocol.

In some embodiments, providing the information about the emergency situation from the endpoint device of the user to the additional endpoint device may include establishing a secure connection between the endpoint device of the user and the additional endpoint device using a public key of the individual capable of assisting the user in the emergency situation. In such embodiments, the additional endpoint device may distribute the public key of the individual to the endpoint device of the user alongside the attribute of the individual.

In some examples, the method may further include (i) detecting that the user of the endpoint device is involved in an additional emergency situation and (ii) determining that no individual capable of assisting the user in the emergency situation is currently nearby the user. In these examples, the method may include alerting an emergency response agency about the emergency situation.

In one embodiment, a system for providing assistance to users in emergency situations may include several modules stored in memory, including (i) a detection module that detects that a user of an endpoint device is involved in an emergency situation, (ii) an identification module that identifies an individual capable of assisting the user in the emergency situation by (a) locating an additional endpoint device that is nearby the endpoint device of the user and (b) determining that the additional endpoint device asserts an attribute of the individual that indicates the individual is qualified to assist the user involved in the emergency situation and is verified by a trusted third party, and (iii) an information module that enables the individual to assist the user involved in the emergency situation by providing information about the emergency situation from the endpoint device of the user to the additional endpoint device. In addition, the system may include at least one physical processor configured to execute the detection module, the identification module, and the information module.

In some examples, the above-described method may be encoded as computer-readable instructions on a non-transitory computer-readable medium. For example, a computer-readable medium may include one or more computer-executable instructions that, when executed by at least one processor of a computing device, may cause the computing device to (i) detect that a user of an endpoint device is involved in an emergency situation, (ii) identify an individual capable of assisting the user in the emergency situation by (a) locating an additional endpoint device that is nearby the endpoint device of the user and (b) determining that the additional endpoint device asserts an attribute of the individual that indicates the individual is qualified to assist the user involved in the emergency situation and is verified by a trusted third party, and (iii) enable the individual to assist the user involved in the emergency situation by providing information about the emergency situation from the endpoint device of the user to the additional endpoint device.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of example embodiments and are a part of the specification. Together with the following description, these drawings demonstrate and explain various principles of the instant disclosure.

FIG. 4 is a table of example individuals qualified to assist in emergency situations.

Figure 1:
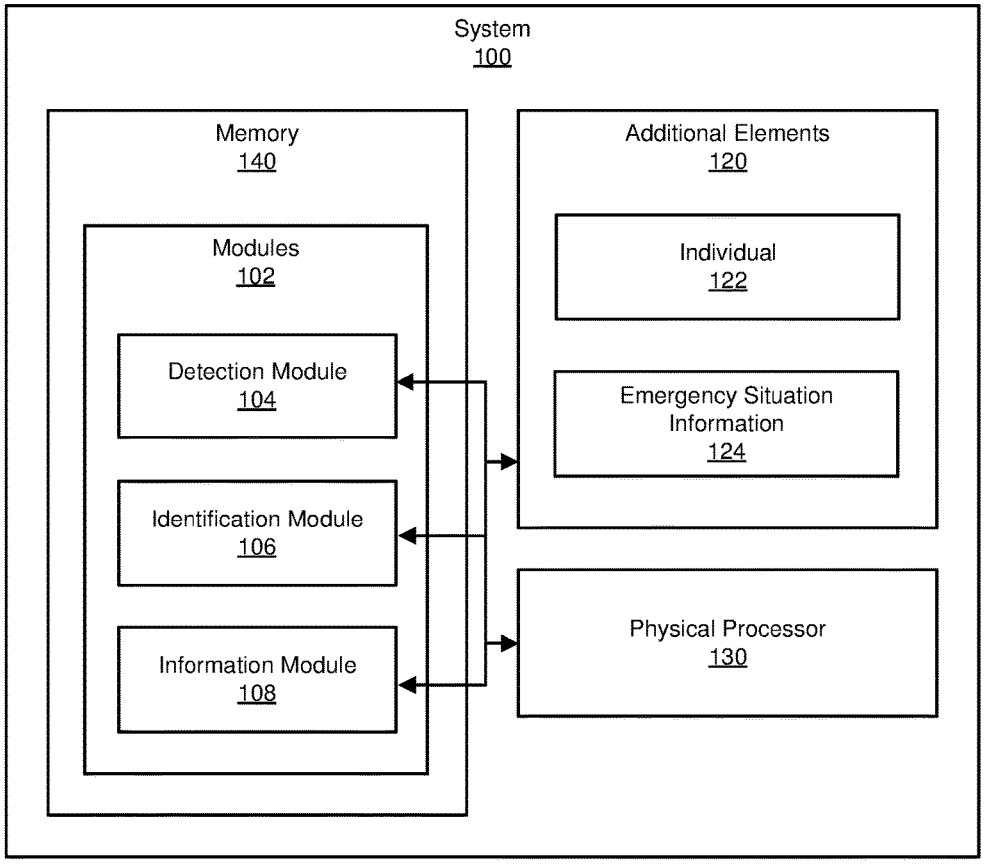
FIG. 1 is a block diagram of an example system for providing assistance to users in emergency situations.

Throughout the drawings, identical reference characters and descriptions indicate similar, but not necessarily identical, elements. While the example embodiments described herein are susceptible to various modifications and alternative forms, specific embodiments have been shown by way of example in the drawings and will be described in detail herein. However, the example embodiments described herein are not intended to be limited to the particular forms disclosed. Rather, the instant disclosure covers all modifications, equivalents, and alternatives falling within the scope of the appended claims.

DETAILED DESCRIPTION OF EXAMPLE EMBODIMENTS

The present disclosure is generally directed to systems and methods for providing assistance to users in emergency situations. As will be explained in greater detail below, after detecting that a user is experiencing an emergency or crisis, the disclosed systems and methods may identify a nearby individual qualified to provide assistance to the user. For example, the systems and methods described herein may determine that the individual's endpoint device is within a certain distance from the user and that the endpoint device broadcasts one or more qualifications (such as an occupation or degree) that indicate the individual has appropriate skills or experience to help the user. By providing the individual with information that identifies the location and nature of the emergency, the disclosed systems and methods may efficiently connect the user experiencing the emergency with the individual qualified to provide assistance.

In addition, the systems and methods described herein may improve the functioning of a computing device by enabling the computing device to contact an individual or organization most capable of assisting a user in an emergency situation. These systems and methods may also improve emergency-assistance services by both quickly identifying individuals capable of helping users in emergency situations and reducing time and resources consumed by false-positive emergencies reported to emergency response agencies.

Figure 2:
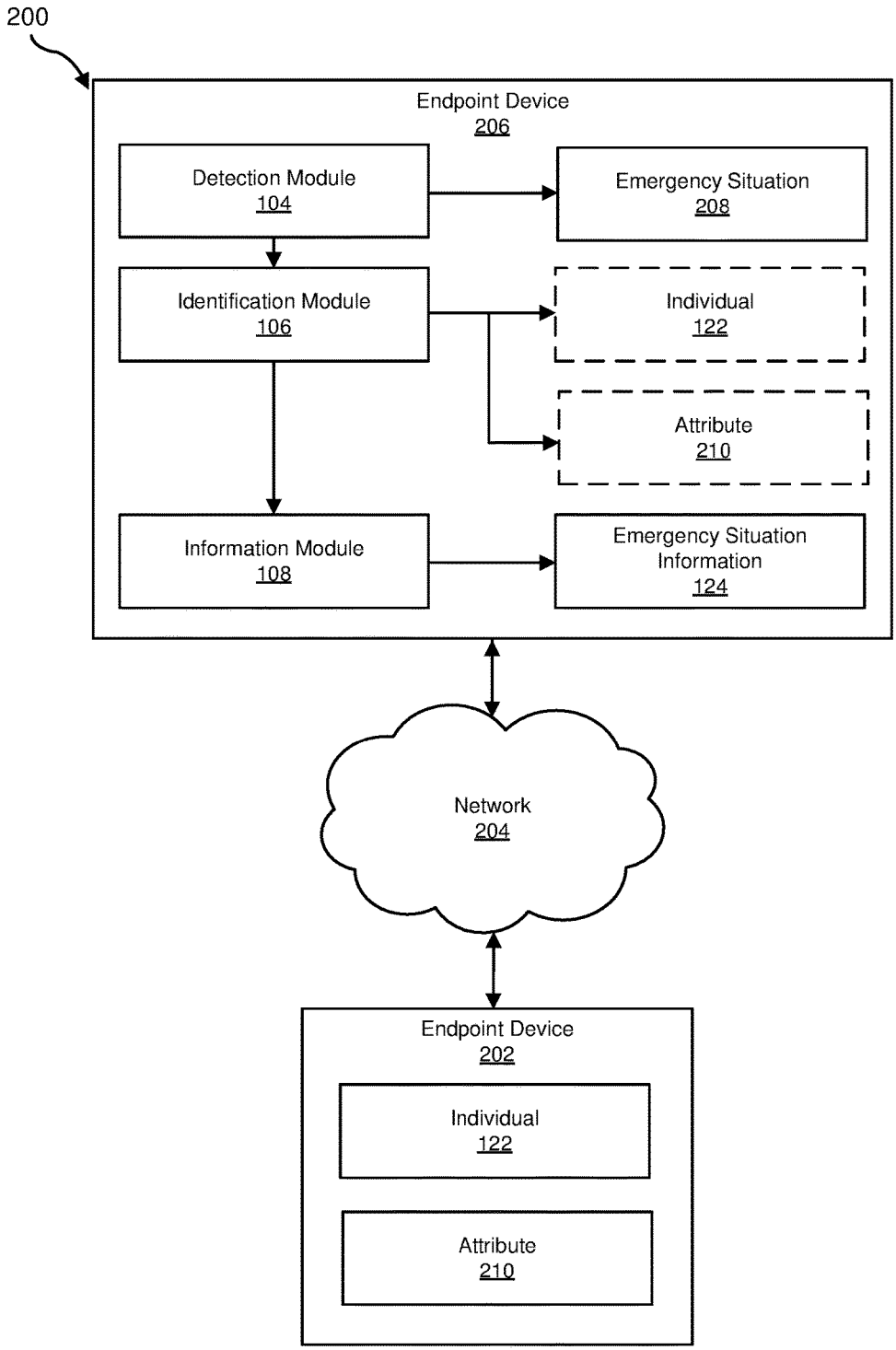
FIG. 2 is a block diagram of an additional example system for providing assistance to users in emergency situations.

The following will provide, with reference to FIGS. 1 and 2, detailed descriptions of example systems for providing assistance to users in emergency situations. Detailed descriptions of corresponding computer-implemented methods will also be provided in connection with FIGS. 3, 5, and 6. Detailed descriptions of example individuals qualified to assist in emergency situations will be provided in connection with FIG. 4. In addition, detailed descriptions of an example computing system and network architecture capable of implementing one or more of the embodiments described herein will be provided in connection with FIGS. 7 and 8, respectively.

FIG. 1 is a block diagram of an example system 100 for providing assistance to users in emergency situations. As illustrated in this figure, example system 100 may include one or more modules 102 for performing one or more tasks. As will be explained in greater detail below, example system 100 may include a detection module 104 that detects that a user of an endpoint device is involved in an emergency situation. In addition, example system 100 may include an identification module 106 that identifies an individual capable of assisting the user in the emergency situation by (i) locating an additional endpoint device that is nearby the endpoint device of the user and (ii) determining that the additional endpoint device asserts an attribute of the individual that indicates the individual is qualified to assist the user involved in the emergency situation and is verified by a trusted third party. Example system 100 may also include an information module 108 that enables the individual to assist the user involved in the emergency situation by providing information about the emergency situation from the endpoint device of the user to the additional endpoint device. Although illustrated as separate elements, one or more of modules 102 in FIG. 1 may represent portions of a single module or application.

In certain embodiments, one or more of modules 102 in FIG. 1 may represent one or more software applications or programs that, when executed by a computing device, may cause the computing device to perform one or more tasks. For example, and as will be described in greater detail below, one or more of modules 102 may represent modules stored and configured to run on one or more computing devices, such as the devices illustrated in FIG. 2 (e.g., endpoint device 202 and/or endpoint device 206). One or more of modules 102 in FIG. 1 may also represent all or portions of one or more special-purpose computers configured to perform one or more tasks.

As illustrated in FIG. 1, example system 100 may also include one or more memory devices, such as memory 140. Memory 140 generally represents any type or form of volatile or non-volatile storage device or medium capable of storing data and/or computer-readable instructions. In one example, memory 140 may store, load, and/or maintain one or more of modules 102. Examples of memory 140 include, without limitation, Random Access Memory (RAM), Read Only Memory (ROM), flash memory, Hard Disk Drives (HDDs), Solid-State Drives (SSDs), optical disk drives, caches, variations or combinations of one or more of the same, and/or any other suitable storage memory.

As illustrated in FIG. 1, example system 100 may also include one or more physical processors, such as physical processor 130. Physical processor 130 generally represents any type or form of hardware-implemented processing unit capable of interpreting and/or executing computer-readable instructions. In one example, physical processor 130 may access and/or modify one or more of modules 102 stored in memory 140. Additionally or alternatively, physical processor 130 may execute one or more of modules 102 to facilitate providing assistance to users in emergency situations. Examples of physical processor 130 include, without limitation, microprocessors, microcontrollers, Central Processing Units (CPUs), Field-Programmable Gate Arrays (FPGAs) that implement softcore processors, Application-Specific Integrated Circuits (ASICs), portions of one or more of the same, variations or combinations of one or more of the same, and/or any other suitable physical processor.

As illustrated in FIG. 1, example system 100 may also include one or more additional elements 120. In some examples, additional elements 120 may include an identification or description of one or more individuals, such as individual 122. Individual 122 generally represents any person or group of people the disclosed systems determine is capable of assisting a user in an emergency situation. Additional elements 120 may also include information that describes one or more emergency situations, such as emergency situation information 124. Emergency situation information 124 generally represents any data sent to individual 122 that may enable individual 122 to assist a user in an emergency situation. In one example, emergency situation information 124 may identify a type of emergency situation that is currently occurring, a geographic location of the emergency situation, and/or information about the user involved in the emergency situation.

As used herein, the terms "user" and "individual" may generally be interchangeable. However, for clarity purposes, the term "user" may generally refer to a person affected by an emergency situation and the term "individual" may generally refer to a person providing assistance in an emergency situation.

Example system 100 in FIG. 1 may be implemented in a variety of ways. For example, all or a portion of example system 100 may represent portions of example system 200 in FIG. 2. As shown in FIG. 2, system 200 may include an endpoint device 202 in communication with an endpoint device 206 via a network 204. In one example, all or a portion of the functionality of modules 102 may be performed by endpoint device 202, endpoint device 206, and/or any other suitable computing system. As will be described in greater detail below, one or more of modules 102 from FIG. 1 may, when executed by at least one processor of endpoint device 202 and/or endpoint device 206, enable endpoint device 202 and/or endpoint device 206 to provide assistance to a user in an emergency situation.

For example, and as will be described in greater detail below, detection module 104 may cause endpoint device 206 to detect that a user of endpoint device 206 is involved in an emergency situation 208. Identification module 106 may then cause endpoint device 206 to identify individual 122 that is capable of assisting the user involved in emergency situation 208 by (i) locating endpoint device 202 that is nearby endpoint device 206 and (ii) determining that endpoint device 202 asserts an attribute 210 of individual 122 that indicates individual 122 is qualified to assist the user in emergency situation 208 and is verified by a trusted third party. Next, information module 108 may cause endpoint device 206 to enable individual 122 to assist the user involved in emergency situation 208 by providing emergency situation information 124 from endpoint device 206 to endpoint device 202.

Endpoint device 202 and endpoint device 206 generally represent any type or form of computing device capable of reading computer-executable instructions. In some examples, endpoint device 202 and endpoint device 206 may represent computing devices of users that run client-side emergency-assistance applications. These emergency-assistance applications may enable users in emergency situations to identify and communicate with individuals capable of providing assistance. In addition, the emergency-assistance applications may enable users to respond to requests for assistance from other individuals involved in emergency situations. Examples of endpoint devices 202 and 206 include, without limitation, laptops, tablets, desktops, servers, cellular phones, Personal Digital Assistants (PDAs), multimedia players, embedded systems, wearable devices (e.g., devices that monitor medical conditions, smart watches, smart glasses, etc.), gaming consoles, variations or combinations of one or more of the same, and/or any other suitable computing device.

Network 204 generally represents any medium or architecture capable of facilitating communication or data transfer. In one example, network 204 may facilitate communication between endpoint device 202 and endpoint device 206. In this example, network 204 may facilitate communication or data transfer using wireless and/or wired connections. Examples of network 204 include, without limitation, an intranet, a Wide Area Network (WAN), a Local Area Network (LAN), a Personal Area Network (PAN), the Internet, Power Line Communications (PLC), a cellular network (e.g., a Global System for Mobile Communications (GSM) network), portions of one or more of the same, variations or combinations of one or more of the same, and/or any other suitable network.

In some examples, example system 200 may include one or more servers. For example, system 200 may include a backend server that provides and/or configures client-side emergency-assistance applications. In one embodiment, this backend server may host a platform from which endpoint devices may download and install such applications. In addition, and as will be explained in greater detail below, this backend server may verify attributes of individuals that indicate the individuals are qualified to assist in emergency situations.

Figure 3:
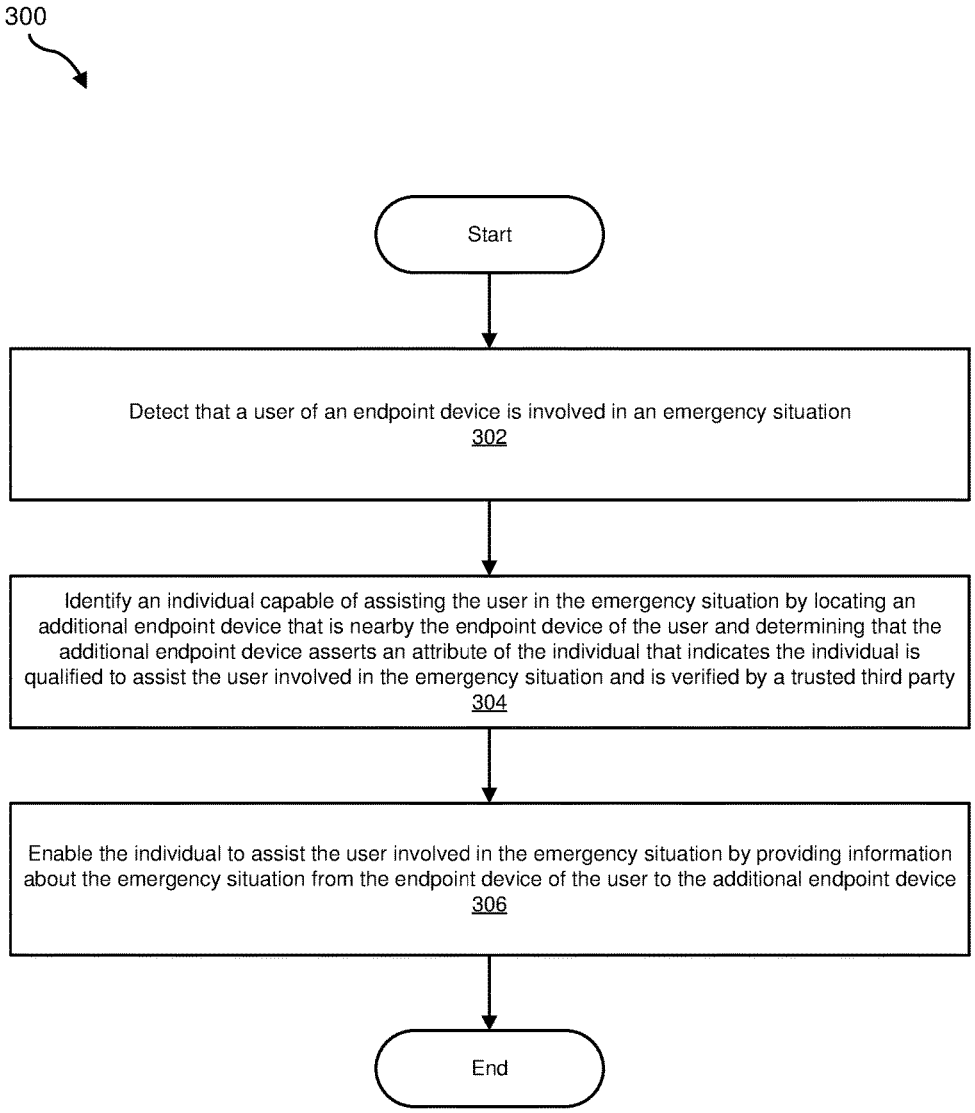
FIG. 3 is a flow diagram of an example method for providing assistance to users in emergency situations.

FIG. 3 is a flow diagram of an example computer-implemented method 300 for providing assistance to users in emergency situations. The steps shown in FIG. 3 may be performed by any suitable computer-executable code and/or computing system, including system 100 in FIG. 1, system 200 in FIG. 2, and/or variations or combinations of one or more of the same. In one example, each of the steps shown in FIG. 3 may represent an algorithm whose structure includes and/or is represented by multiple sub-steps, examples of which will be provided in greater detail below.

As illustrated in FIG. 3, at step 302 one or more of the systems described herein may detect that a user of an endpoint device is involved in an emergency situation. For example, detection module 104 may, as part of endpoint device 206 in FIG. 2, detect that a user of endpoint device 206 is involved in emergency situation 208.

The term "emergency situation," as used herein, generally refers to any type or form of incident, action, or condition that may compromise the health, safety, and/or general well-being of one or more users. In general, an emergency situation may represent any dangerous or suspicious event that may be stopped, mitigated, or controlled by an individual with proper qualifications (such as a doctor, lifeguard, police officer, member of the military, etc.). A user may be involved in an emergency situation in a variety of ways, such as by being personally affected by the emergency situation, witnessing the emergency situation, and/or being within the vicinity of the emergency situation. Examples of emergency situations include, without limitation, medical emergencies (e.g., heart attacks, injuries, etc.), public safety emergencies (e.g., crimes), family emergencies (e.g., lost children), and natural disaster emergencies (e.g., hurricanes, earthquakes, etc.).

The systems described herein may detect that a user is involved in an emergency situation in a variety of ways. In some examples, detection module 104 may be configured to detect one or more particular types of emergency situations that a user is likely to experience. For example, the disclosed systems may be incorporated into endpoint devices that contain one or more biological sensors that monitor health levels of a user. Such endpoint devices (e.g., wearable medical devices) may monitor a variety of health indicators of users that suffer from health conditions that increase the likelihood that the users will experience medical emergencies. In one example, a wearable medical device of a user with a heart condition may monitor the user's blood pressure, heartbeat, adrenaline level, body temperature, and/or additional indications of stress (such as ambient noise levels). In another example, a wearable medical device of a user with diabetes may monitor the user's glucose level. Such wearable medical devices may periodically or continuously monitor particular health indications of a user to detect potentially dangerous changes in the user's biological functions. In the event that a wearable medical device detects an extreme or severe change in a user's health, detection module 104 may determine that the user is experiencing a medical emergency.

In other examples, detection module 104 may detect an emergency situation by monitoring alerts or electronic communications distributed to a user's endpoint device that indicate an emergency is currently occurring (or has recently occurred) nearby the user. For example, detection module 104 may receive, monitor, and/or subscribe to notifications from local emergency response agencies (e.g., police stations and weather services) that identify ongoing or recently-detected emergency situations (such as crimes or natural disasters). In other examples, detection module 104 may determine that a user is involved in an emergency situation by monitoring the user's outgoing messages, phone calls, and/or additional communications. For example, detection module 104 may determine that a user is involved in an emergency situation in the event that the user attempts to dial "911" on their mobile phone.

Additionally or alternatively, detection module 104 may detect an emergency situation based on direct input from a user. For example, detection module 104 may provide a user interface that enables a user to enter information that identifies an emergency situation. In this way, the user may report any type or form of emergency situation occurring nearby the user, such as emergency situations the user witnesses and/or emergency situations not detected by a wearable medical device or reported by an emergency response agency.

Detection module 104 may identify a variety of information about an emergency situation. In one embodiment, detection module 104 may identify a type or category of an emergency situation. For example, detection module 104 may classify an emergency situation as a medical emergency, a personal emergency, a crime-related emergency, a public emergency, or any additional type of emergency. In addition, detection module 104 may identify an individual or group of individuals that are most likely to be negatively impacted by an emergency situation. For example, detection module 104 may determine whether an emergency situation will affect the user of the endpoint device on which detection module 104 is running, an additional individual that the user has witnessed experiencing the emergency situation, and/or the general public (e.g., any individuals within the vicinity of the emergency situation).

Additionally, detection module 104 may determine a geographic location of an emergency situation. For example, detection module 104 may identify Global Positioning Service (GPS) coordinates, an address, a landmark, a neighborhood, and/or a region (e.g., a park, stadium, etc.) at which an emergency situation is occurring. As will be explained in greater detail below, by determining such contextual information about emergency situations, the disclosed systems may efficiently enable qualified individuals to assist users involved in the emergency situations.

Returning to FIG. 3, at step 304 one or more of the systems described herein may identify an individual capable of assisting the user in the emergency situation by (i) locating an additional endpoint device that is nearby the endpoint device of the user and (ii) determining that the additional endpoint device asserts an attribute of the individual that indicates the individual is qualified to assist the user involved in the emergency situation and is verified by a trusted third party. For example, identification module 106 may, as part of endpoint device 206 in FIG. 2, identify individual 122 that is capable of assisting the user involved in emergency situation 208 by (i) locating endpoint device 202 nearby endpoint device 206 and (ii) determining that endpoint device 202 asserts attribute 210.

The term "attribute," as used herein, generally refers to any type or form of label or trait that describes an individual and/or a qualification of an individual. In some embodiments, an attribute of an individual may indicate an educational level or degree of the individual. For example, an attribute may indicate that an individual has a nursing degree or is currently enrolled in medical school. Similarly, an attribute may indicate an occupation of an individual. For example, an attribute may indicate that an individual is a physician, a police officer, or a member of the military. In addition, an attribute may describe an individual's work experience, such as the individual's employer, the individual's place of work, an age of the individual, and/or an amount of time the individual has been employed in a particular field. For example, an attribute may indicate that an individual has worked as a cardiologist for 14 years. Additionally or alternatively, an attribute may identify one or more certifications issued to an individual. For example, an attribute may indicate that an individual is a certified lifeguard and/or has been trained to perform cardiopulmonary resuscitation (CPR).

In some embodiments, the disclosed systems may verify attributes of individuals before the individuals assist users in emergency situations. For example, an individual that wishes to provide assistance to users in emergency situations may apply to be verified by an emergency-assistance service. In particular, an individual may provide one or more attributes to the emergency-assistance service and the service may then attempt to verify the authenticity or legitimacy of the attributes. For example, the service may research publicly-available qualifications of an individual and/or perform a background check on the individual. In the event that the service verifies an attribute of an individual, the service may provide an endpoint device of the individual with an application or software agent that enables the individual to assert the verified attribute to users involved in emergency situations. For example, the service may configure an electronic identification, a smart badge, and/or a wearable device that asserts each of the individual's verified attributes. Moreover, as will be explained in greater detail below, an emergency-assistance service may provide a verified individual with an encryption key pair that enables verification of the individual's attribute by a user's endpoint device and/or facilitates establishing a secure connection with the individual's endpoint device.

The disclosed systems may identify an individual capable of assisting a user in an emergency situation in a variety of ways. In some examples, identification module 106 may identify a qualified individual by broadcasting requests for assistance to all or a portion of the endpoint devices nearby an endpoint device of a user involved in an emergency situation. For example, identification module 106 may broadcast requests to all endpoint devices within a certain range from the user and/or all endpoint devices capable of receiving the requests. These requests may contain a variety of information, such as a category of a detected emergency situation, a location of the emergency situation, and/or a desired attribute of an individual requested to provide assistance. For example, in the event that detection module 104 determines that a user is having a heart attack, identification module 106 may broadcast a message that requests assistance from physicians, nurses, individuals trained in CPR, and/or similarly-qualified individuals. In addition, such a broadcast may contain information that identifies the endpoint device from the which the broadcast originated and/or information that facilitates establishing a secure connection with the endpoint device (such as a public key of the user involved in the emergency situation).

In some embodiments, a broadcast distributed by identification module 106 may be received by one or more endpoint devices configured to identify and respond to such broadcasts. For example, a distributed broadcast may be received by an endpoint device of an individual that has one or more attributes verified by an emergency-assistance service. In this example, the endpoint device of the individual may respond to the broadcast with a message that includes the attributes of the individual and indicates that the individual is available to provide assistance. In one embodiment, the individual may initiate or direct this response. For example, the individual may review the request for assistance and determine that they are capable of and available to provide assistance. In other embodiments, the endpoint device of the individual may be configured to automatically respond to the received broadcast.

Additionally or alternatively, identification module 106 may identify qualified individuals based on attributes automatically distributed by the individuals' endpoint devices. For example, an endpoint device of an individual with one or more verified attributes may continuously or periodically broadcast the attributes such that any nearby endpoint device of a user involved in an emergency situation may receive the attributes. In these examples, after detection module 104 determines that a user is involved in an emergency situation, identification module 106 may begin identifying or listening for broadcasted attributes from nearby endpoint devices. In some embodiments, an individual may manually configure their endpoint device to broadcast attributes during certain times and/or while in certain locations.

After identifying an attribute asserted by an individual's endpoint device, identification module 106 may determine whether the attribute qualifies the individual to assist a user involved in an emergency situation. For example, identification module 106 may determine whether the attribute has been verified by a trusted third party (e.g., by authenticating a digital signature of the trusted third party distributed alongside the attribute). In addition, identification module 106 may determine whether an attribute indicates that an individual has the necessary skills or experience to aid a user. For example, identification module 106 may compare an identified attribute with a predetermined list of attributes that qualify individuals to assist in particular types of emergency situations.

In some examples, identification module 106 may search for qualified individuals within a certain geographic distance from a user involved in an emergency situation. For example, identification module 106 may identify a geographic location of a user (e.g., based on GPS coordinates of the user's endpoint device) and then determine whether any endpoint devices of qualified individuals are currently within a certain degree of proximity from the user. As an example, identification module 106 may identify all qualified individuals that are within a certain radius (e.g., 100 yards, 0.5 miles, etc.) of a user in an emergency situation or within the same geographic region (e.g., public park, city block, etc.) as the user.

Identification module 106 may identify nearby endpoint devices of individuals qualified to assist users in emergency situations using a variety of communication protocols. In one embodiment, identification module 106 may identify endpoint devices of qualified individuals via one or more short range communication protocols (e.g., wireless network, Bluetooth, infrared, and/or ZigBee protocols). Using such protocols may enable identification module 106 to quickly and accurately identify individuals that are geographically close to a user involved in an emergency situation. In addition, these protocols may enable identification module 106 to identify qualified individuals in the event that cellular networks and/or other widespread communication infrastructures are unavailable. However, identification module 106 may distribute and receive communications via any type or form of communication protocol, including mid-range and long-range protocols.

In some examples, identification module 106 may determine that no individual qualified to assist a user involved in an emergency situation is currently located nearby the user. For example, after initiating a search to identify a qualified individual, identification module 106 may fail to receive or identify attributes of any qualified individuals within a predetermined amount of time (e.g., 30 seconds, 1 minute, etc.). In one embodiment, identification module 106 may expand a radius or region of search in the event that an initial search fails to reveal a qualified individual. For example, identification module 106 may broadcast new requests for assistance using a long-range communication protocol. Additionally or alternatively, identification module 106 may facilitate contacting an emergency response agency capable of assisting the user in the emergency situation. For example, identification module 106 may inform the user that a qualified individual could not be identified and then direct the user to dial "911" to receive assistance. In another example, identification module 106 may automatically (i.e., without input from the user) contact an appropriate emergency response agency and report information about the detected emergency situation (e.g., via an automated phone call or electronic message).

Notably, in some embodiments, identification module 106 may contact an emergency response agency in addition to identifying an individual capable of assisting a user in an emergency situation. For example, in the event that detection module 104 detects a potentially life-threatening emergency (e.g., a medical crisis or a violent crime), identification module 106 may facilitate providing all possible forms of assistance to a user.

In some embodiments, identification module 106 may identify multiple individuals qualified to assist a user in an emergency situation. For example, identification module 106 may determine that multiple endpoint devices have responded to a broadcasted request for assistance. Additionally or alternatively, identification module 106 may determine that multiple endpoint devices are currently broadcasting attributes that indicate the owners of the endpoint devices are qualified to assist a user in an emergency situation. In some embodiments, identification module 106 may select an individual from among a group of identified individuals that is most qualified to assist a user.

Identification module 106 may identify an individual most qualified to assist a user in an emergency situation in a variety of ways. In one example, identification module 106 may enable the user involved in the emergency situation to select the most appropriate individual. For example, identification module 106 may present attributes of each individual to the user and allow the user to provide input that identifies a particular individual. In other embodiments, identification module 106 may compare or analyze attributes of identified individuals to select the most qualified individual without input from the user. In this way, identification module 106 may provide assistance to users involved in serious emergency situations that prevent the users from reviewing attributes of identified individuals.

In some examples, identification module 106 may select a most-qualified individual based on a predetermined metric or set of rules. For example, identification module 106 may compare attributes of identified individuals with a prioritized list of attributes that orders or ranks various occupations, certifications, education levels, etc. according to a likelihood that these attributes enable an individual to help in a particular type of emergency situation. Such a list may be provided by a user or by an emergency-assistance service.

As an example, FIG. 4 illustrates a table of individuals qualified to assist in emergency situations 402. In this example, table 402 may identify prioritized individuals for various types of emergency situations. As shown in FIG. 4, table 402 may indicate that a doctor is the most highly prioritized individual to assist in a medical emergency, followed by a medical student and then a certified individual (e.g., an Emergency Medical Technician (EMT)). In accordance with table 402, in the event that both a medical student and a certified individual are available to assist in a medical emergency, identification module 106 may select the medical student to provide assistance. In addition, the "priority 4" field of table 402 may indicate that identification module 106 should facilitate connecting a user to an emergency response agency in the event that neither a doctor nor a medical student nor a certified individual is available.

Furthermore, table 402 may indicate that a police officer is prioritized over a security guard during a public safety emergency and that an emergency response agency should be contacted in the event that neither a police officer nor a security guard is available. Finally, table 402 may indicate that an emergency response agency should be contacted in the event that a child services workers is not available to assist in a family emergency. In general, identification module 106 may select an individual most qualified to assist in an emergency situation based on any one or combination of attributes of the individual and/or based on any type of additional contextual information, such as a distance between the individual and a user or a frequency with which the individual provides assistance in emergency situations.

Returning to FIG. 3, at step 308 one or more systems described herein may enable the individual to assist the user involved in the emergency situation by providing information about the emergency situation from the endpoint device of the user to the additional endpoint device. For example, information module 108 may, as part of endpoint device 206 in FIG. 2, enable individual 122 to assist the user involved in emergency situation 208 by providing emergency situation information 124 from endpoint device 206 to endpoint device 202.

The systems described herein may provide information about an emergency situation to an individual qualified to assist in the emergency situation in a variety of ways. In general, information module 108 may provide any type or form of information that enables a qualified individual to locate a user involved in an emergency situation and perform appropriate actions to mitigate, reverse, stop, or prevent harmful consequences of the emergency situation. For example, information module 108 may provide GPS coordinates, an address, and/or an additional type of location information that identifies where an emergency situation is occurring. In some embodiments, information module 108 may also provide directions that lead a qualified individual to a user (e.g., using a built-in map or direction service within the individual's endpoint device). In addition, information module 108 may provide information that identifies a user to a qualified individual, such as the user's name, an image of the user, and/or a physical description of the user.

Information module 108 may also describe specific events or details of an emergency situation, such as a type or classification assigned to the emergency situation, events surrounding the emergency situation, and/or pertinent details of users involved in the emergency situation. For example, in the event that a user is experiencing a heart attack, information module 108 may provide a medical history of the user (such as the user's known heart conditions, current medications, and/or healthcare provider). In the event that a user has been assaulted or robbed, information module 108 may provide information about items stolen from the user, injuries the user sustained, and/or a description of a suspect who committed the crime.

In some embodiments, information module 108 may provide information about an emergency situation via a secure connection between a user's endpoint device and the endpoint device of an individual assisting the user. In this way, information module 108 may protect sensitive and/or confidential data (such as medical records) as the data is distributed between the endpoint devices. In one embodiment, information module 108 may establish such a secure connection using a public key of a qualified individual assisting a user. For example, information module 108 may identify the public key of the individual within a broadcast or message sent from the individual's endpoint device and then encrypt information about the emergency situation using the public key. The individual's endpoint device may decrypt the information using a corresponding private key known only to the individual (or an emergency-assistance service). Alternatively, information module 108 may encrypt and distribute information about an emergency situation using a public key associated with the user involved in the emergency situation. In general, information module 108 may securely transfer information about an emergency situation using any type or form of network, protocol, or communication infrastructure that protects the information from alteration and/or unauthorized access.

Figure 5:
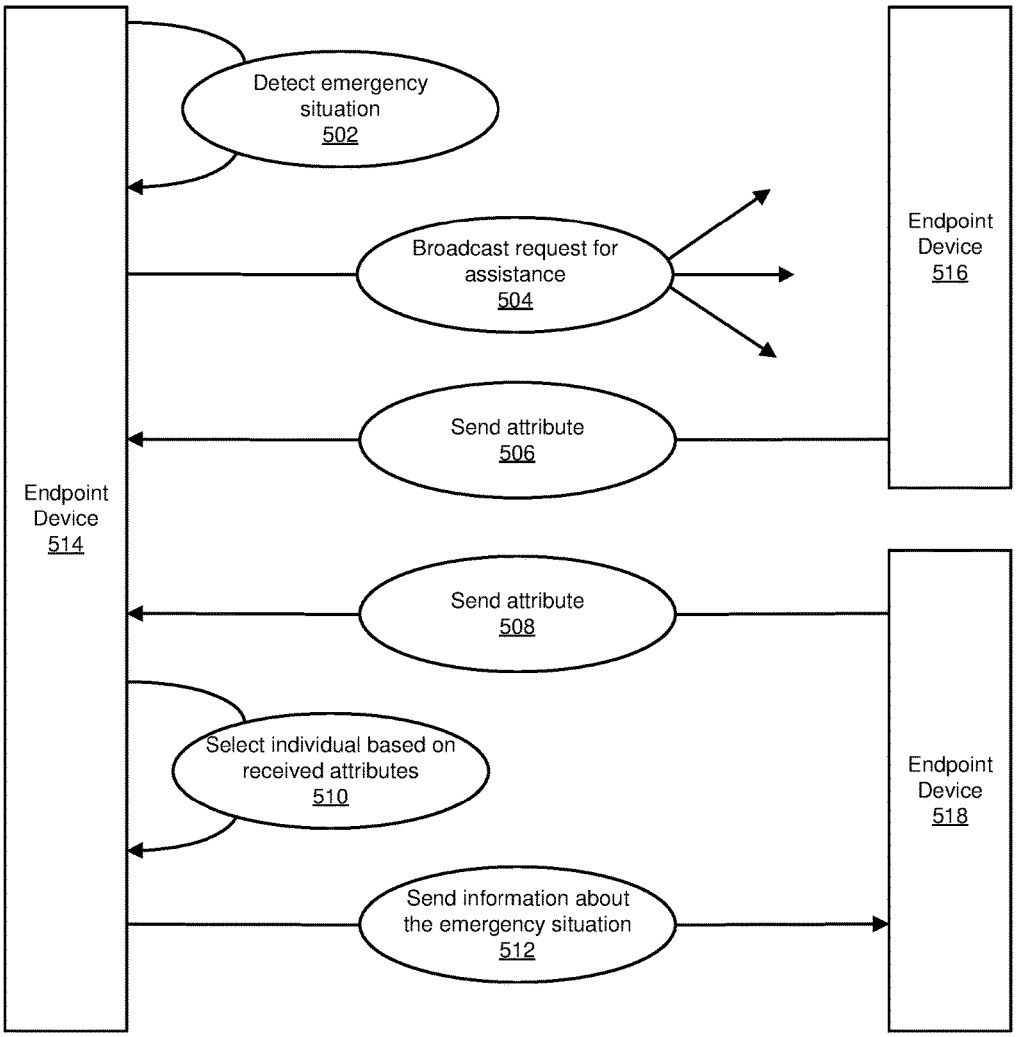
FIG. 5 is a block diagram of an additional example method for providing assistance to users in emergency situations.

As explained above in connection with FIG. 3, the disclosed systems may connect users involved in emergency situations with individuals qualified to assist the users. FIG. 5 illustrates an example embodiment of these systems. In particular, FIG. 5 illustrates interactions between an endpoint device 514 (i.e., an endpoint device of a user involved in an emergency situation) and endpoint devices 516 and 518 (i.e., endpoint devices of individuals qualified to provide assistance in one or more types of emergency situations). As shown in FIG. 5, at step 502 endpoint device 514 may detect that the user of endpoint device 514 is involved in an emergency situation. At step 504, endpoint device 514 may broadcast requests for assistance to all or a portion of nearby endpoint devices. At step 506, endpoint device 516 may receive the broadcast from endpoint device 514 and respond by distributing an attribute of the individual associated with endpoint device 516 to endpoint device 514. Similarly, at step 508 endpoint device 518 may receive the broadcast from endpoint device 514 and respond by distributing an attribute of the individual associated with endpoint device 518 to endpoint device 514. At step 510, endpoint device 514 may compare the attributes received from endpoint device 516 and endpoint device 518 to select the individual most qualified to assist the user of endpoint device 514. In the example of FIG. 5, endpoint device 514 may determine that the owner of endpoint device 518 is most qualified to assist the user. Accordingly, at step 512 endpoint device 514 may send information about the emergency situation to endpoint device 518.

Figure 6:
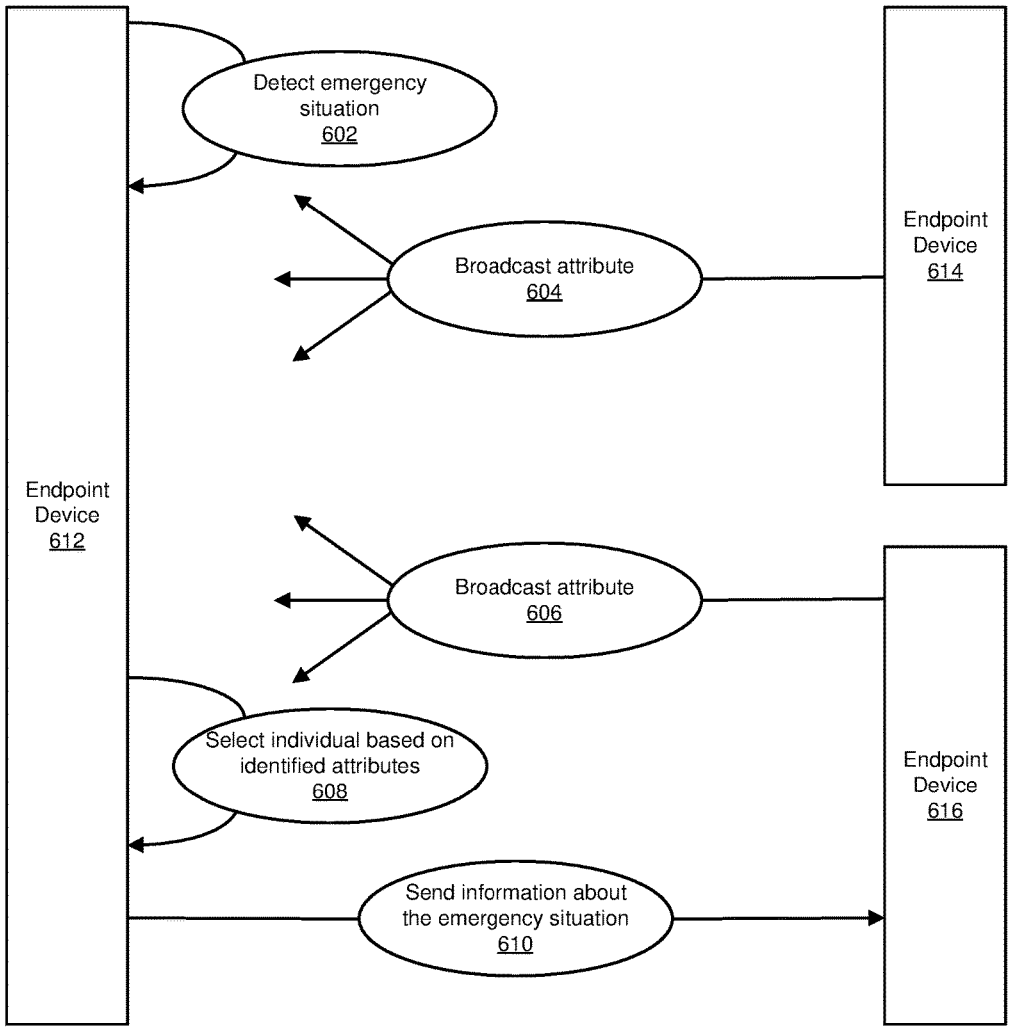
FIG. 6 is a block diagram of an additional example method for providing assistance to users in emergency situations.

FIG. 6 illustrates an additional example embodiment of the disclosed systems. As shown in FIG. 6, at step 602 an endpoint device 612 may detect that a user of endpoint device 612 is involved in an emergency situation. At step 604, endpoint device 612 may determine that an endpoint device 614 broadcasts an attribute of an individual associated with endpoint device 614. Similarly, at step 606 endpoint device 612 may determine that an endpoint device 616 broadcasts an attribute of an individual associated with endpoint device 616. In one embodiment, these broadcasts may be distributed automatically by endpoint devices 614 and 616 (i.e., prior to receiving a communication from endpoint device 612). At step 608, endpoint device 612 may compare the attributes distributed by endpoint devices 614 and 616 to select the individual most qualified to assist the user of endpoint device 612. In the example of FIG. 6, endpoint device 612 may determine that the owner of endpoint device 616 is most qualified to assist the user. Accordingly, at step 610 endpoint device 612 may send information about the emergency situation to endpoint device 616.

Figure 7:
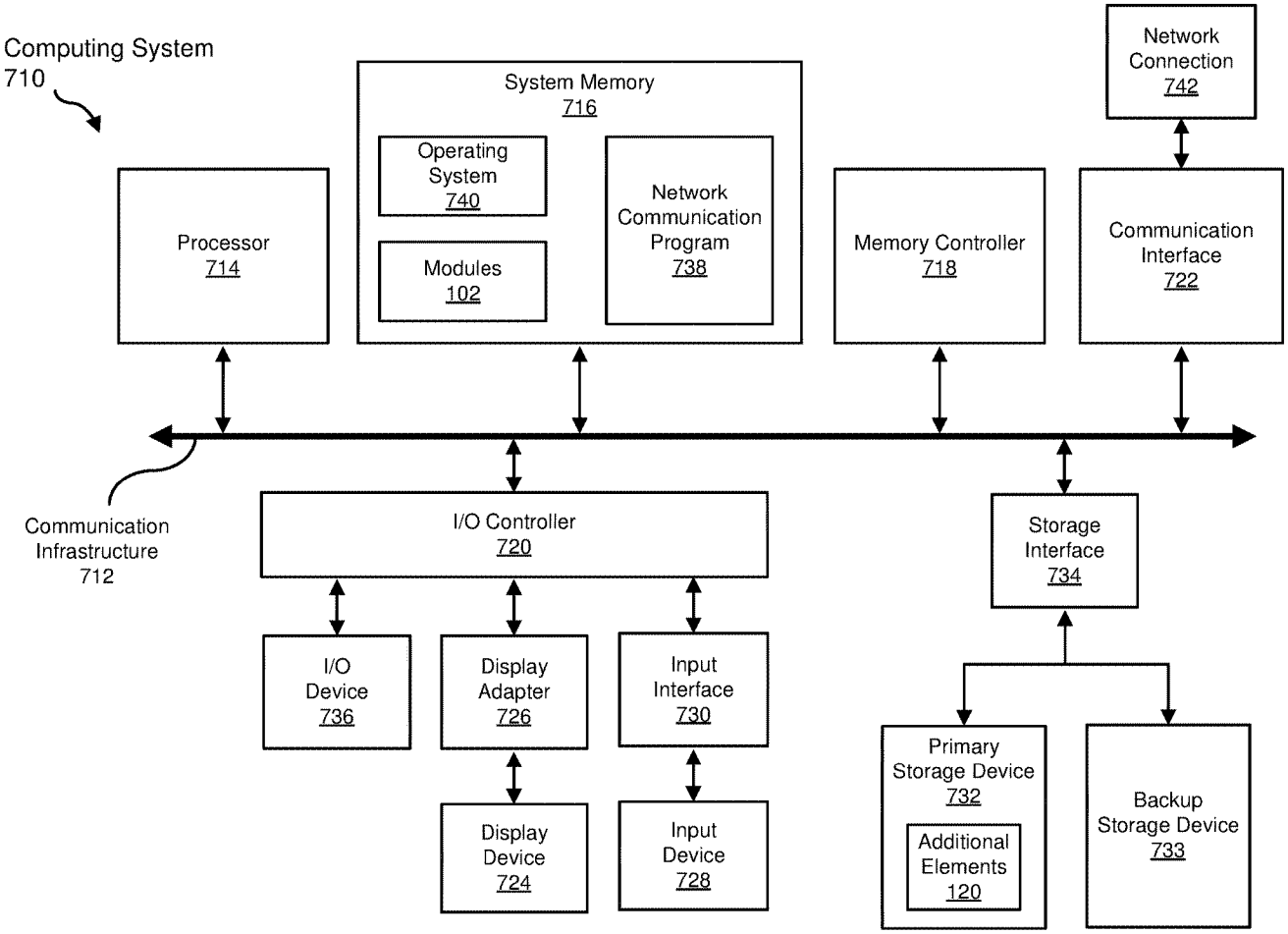
FIG. 7 is a block diagram of an example computing system capable of implementing one or more of the embodiments described and/or illustrated herein.

FIG. 7 is a block diagram of an example computing system 710 capable of implementing one or more of the embodiments described and/or illustrated herein. For example, all or a portion of computing system 710 may perform and/or be a means for performing, either alone or in combination with other elements, one or more of the steps described herein (such as one or more of the steps illustrated in FIG. 3). All or a portion of computing system 710 may also perform and/or be a means for performing any other steps, methods, or processes described and/or illustrated herein.

Computing system 710 broadly represents any single or multi-processor computing device or system capable of executing computer-readable instructions. Examples of computing system 710 include, without limitation, workstations, laptops, client-side terminals, servers, distributed computing systems, handheld devices, or any other computing system or device. In its most basic configuration, computing system 710 may include at least one processor 714 and a system memory 716.

Processor 714 generally represents any type or form of physical processing unit (e.g., a hardware-implemented central processing unit) capable of processing data or interpreting and executing instructions. In certain embodiments, processor 714 may receive instructions from a software application or module. These instructions may cause processor 714 to perform the functions of one or more of the example embodiments described and/or illustrated herein.

System memory 716 generally represents any type or form of volatile or non-volatile storage device or medium capable of storing data and/or other computer-readable instructions. Examples of system memory 716 include, without limitation, Random Access Memory (RAM), Read Only Memory (ROM), flash memory, or any other suitable memory device. Although not required, in certain embodiments computing system 710 may include both a volatile memory unit (such as, for example, system memory 716) and a non-volatile storage device (such as, for example, primary storage device 732, as described in detail below). In one example, one or more of modules 102 from FIG. 1 may be loaded into system memory 716.

In some examples, system memory 716 may store and/or load an operating system 740 for execution by processor 714. In one example, operating system 740 may include and/or represent software that manages computer hardware and software resources and/or provides common services to computer programs and/or applications on computing system 710. Examples of operating system 640 include, without limitation, LINUX, JUNOS, MICROSOFT WINDOWS, WINDOWS MOBILE, MAC OS, APPLE'S 10S, UNIX, GOOGLE CHROME OS, GOOGLE'S ANDROID, SOLARIS, variations of one or more of the same, and/or any other suitable operating system.

In certain embodiments, example computing system 710 may also include one or more components or elements in addition to processor 714 and system memory 716. For example, as illustrated in FIG. 7, computing system 710 may include a memory controller 718, an Input/Output (I/O) controller 720, and a communication interface 722, each of which may be interconnected via a communication infrastructure 712. Communication infrastructure 712 generally represents any type or form of infrastructure capable of facilitating communication between one or more components of a computing device. Examples of communication infrastructure 712 include, without limitation, a communication bus (such as an Industry Standard Architecture (ISA), Peripheral Component Interconnect (PCI), PCI Express (PCIe), or similar bus) and a network.

Memory controller 718 generally represents any type or form of device capable of handling memory or data or controlling communication between one or more components of computing system 710. For example, in certain embodiments memory controller 718 may control communication between processor 714, system memory 716, and I/O controller 720 via communication infrastructure 712.

I/O controller 720 generally represents any type or form of module capable of coordinating and/or controlling the input and output functions of a computing device. For example, in certain embodiments I/O controller 720 may control or facilitate transfer of data between one or more elements of computing system 710, such as processor 714, system memory 716, communication interface 722, display adapter 726, input interface 730, and storage interface 734.

As illustrated in FIG. 7, computing system 710 may also include at least one display device 724 coupled to I/O controller 720 via a display adapter 726. Display device 724 generally represents any type or form of device capable of visually displaying information forwarded by display adapter 726. Similarly, display adapter 726 generally represents any type or form of device configured to forward graphics, text, and other data from communication infrastructure 712 (or from a frame buffer, as known in the art) for display on display device 724.

As illustrated in FIG. 7, example computing system 710 may also include at least one input device 728 coupled to I/O controller 720 via an input interface 730. Input device 728 generally represents any type or form of input device capable of providing input, either computer or human generated, to example computing system 710. Examples of input device 728 include, without limitation, a keyboard, a pointing device, a speech recognition device, variations or combinations of one or more of the same, and/or any other input device.

Additionally or alternatively, example computing system 710 may include additional I/O devices. For example, example computing system 710 may include I/O device 736. In this example, I/O device 736 may include and/or represent a user interface that facilitates human interaction with computing system 710. Examples of I/O device 736 include, without limitation, a computer mouse, a keyboard, a monitor, a printer, a modem, a camera, a scanner, a microphone, a touchscreen device, variations or combinations of one or more of the same, and/or any other I/O device.

Communication interface 722 broadly represents any type or form of communication device or adapter capable of facilitating communication between example computing system 710 and one or more additional devices. For example, in certain embodiments communication interface 722 may facilitate communication between computing system 710 and a private or public network including additional computing systems. Examples of communication interface 722 include, without limitation, a wired network interface (such as a network interface card), a wireless network interface (such as a wireless network interface card), a modem, and any other suitable interface. In at least one embodiment, communication interface 722 may provide a direct connection to a remote server via a direct link to a network, such as the Internet. Communication interface 722 may also indirectly provide such a connection through, for example, a local area network (such as an Ethernet network), a personal area network, a telephone or cable network, a cellular telephone connection, a satellite data connection, or any other suitable connection.

In certain embodiments, communication interface 722 may also represent a host adapter configured to facilitate communication between computing system 710 and one or more additional network or storage devices via an external bus or communications channel. Examples of host adapters include, without limitation, Small Computer System Interface (SCSI) host adapters, Universal Serial Bus (USB) host adapters, Institute of Electrical and Electronics Engineers (IEEE) 1394 host adapters, Advanced Technology Attachment (ATA), Parallel ATA (PATA), Serial ATA (SATA), and External SATA (eSATA) host adapters, Fibre Channel interface adapters, Ethernet adapters, or the like. Communication interface 722 may also allow computing system 710 to engage in distributed or remote computing. For example, communication interface 722 may receive instructions from a remote device or send instructions to a remote device for execution.

In some examples, system memory 716 may store and/or load a network communication program 738 for execution by processor 714. In one example, network communication program 738 may include and/or represent software that enables computing system 710 to establish a network connection 742 with another computing system (not illustrated in FIG. 7) and/or communicate with the other computing system by way of communication interface 722. In this example, network communication program 738 may direct the flow of outgoing traffic that is sent to the other computing system via network connection 742. Additionally or alternatively, network communication program 738 may direct the processing of incoming traffic that is received from the other computing system via network connection 742 in connection with processor 714.

Although not illustrated in this way in FIG. 7, network communication program 738 may alternatively be stored and/or loaded in communication interface 722. For example, network communication program 738 may include and/or represent at least a portion of software and/or firmware that is executed by a processor and/or Application Specific Integrated Circuit (ASIC) incorporated in communication interface 722.

As illustrated in FIG. 7, example computing system 710 may also include a primary storage device 732 and a backup storage device 733 coupled to communication infrastructure 712 via a storage interface 734. Storage devices 732 and 733 generally represent any type or form of storage device or medium capable of storing data and/or other computer-readable instructions. For example, storage devices 732 and 733 may be a magnetic disk drive (e.g., a so-called hard drive), a solid state drive, a floppy disk drive, a magnetic tape drive, an optical disk drive, a flash drive, or the like. Storage interface 734 generally represents any type or form of interface or device for transferring data between storage devices 732 and 733 and other components of computing system 710. In one example, additional elements 120 from FIG. 1 may be stored and/or loaded in primary storage device 732.

In certain embodiments, storage devices 732 and 733 may be configured to read from and/or write to a removable storage unit configured to store computer software, data, or other computer-readable information. Examples of suitable removable storage units include, without limitation, a floppy disk, a magnetic tape, an optical disk, a flash memory device, or the like. Storage devices 732 and 733 may also include other similar structures or devices for allowing computer software, data, or other computer-readable instructions to be loaded into computing system 710. For example, storage devices 732 and 733 may be configured to read and write software, data, or other computer-readable information. Storage devices 732 and 733 may also be a part of computing system 710 or may be a separate device accessed through other interface systems.

Many other devices or subsystems may be connected to computing system 710. Conversely, all of the components and devices illustrated in FIG. 7 need not be present to practice the embodiments described and/or illustrated herein. The devices and subsystems referenced above may also be interconnected in different ways from that shown in FIG. 7. Computing system 710 may also employ any number of software, firmware, and/or hardware configurations. For example, one or more of the example embodiments disclosed herein may be encoded as a computer program (also referred to as computer software, software applications, computer-readable instructions, or computer control logic) on a computer-readable medium. The term "computer-readable medium," as used herein, generally refers to any form of device, carrier, or medium capable of storing or carrying computer-readable instructions. Examples of computer-readable media include, without limitation, transmission-type media, such as carrier waves, and non-transitory-type media, such as magnetic-storage media (e.g., hard disk drives, tape drives, and floppy disks), optical-storage media (e.g., Compact Disks (CDs), Digital Video Disks (DVDs), and BLU-RAY disks), electronic-storage media (e.g., solid-state drives and flash media), and other distribution systems.

The computer-readable medium containing the computer program may be loaded into computing system 710. All or a portion of the computer program stored on the computer-readable medium may then be stored in system memory 716 and/or various portions of storage devices 732 and 733. When executed by processor 714, a computer program loaded into computing system 710 may cause processor 714 to perform and/or be a means for performing the functions of one or more of the example embodiments described and/or illustrated herein. Additionally or alternatively, one or more of the example embodiments described and/or illustrated herein may be implemented in firmware and/or hardware. For example, computing system 710 may be configured as an Application Specific Integrated Circuit (ASIC) adapted to implement one or more of the example embodiments disclosed herein.

Figure 8:
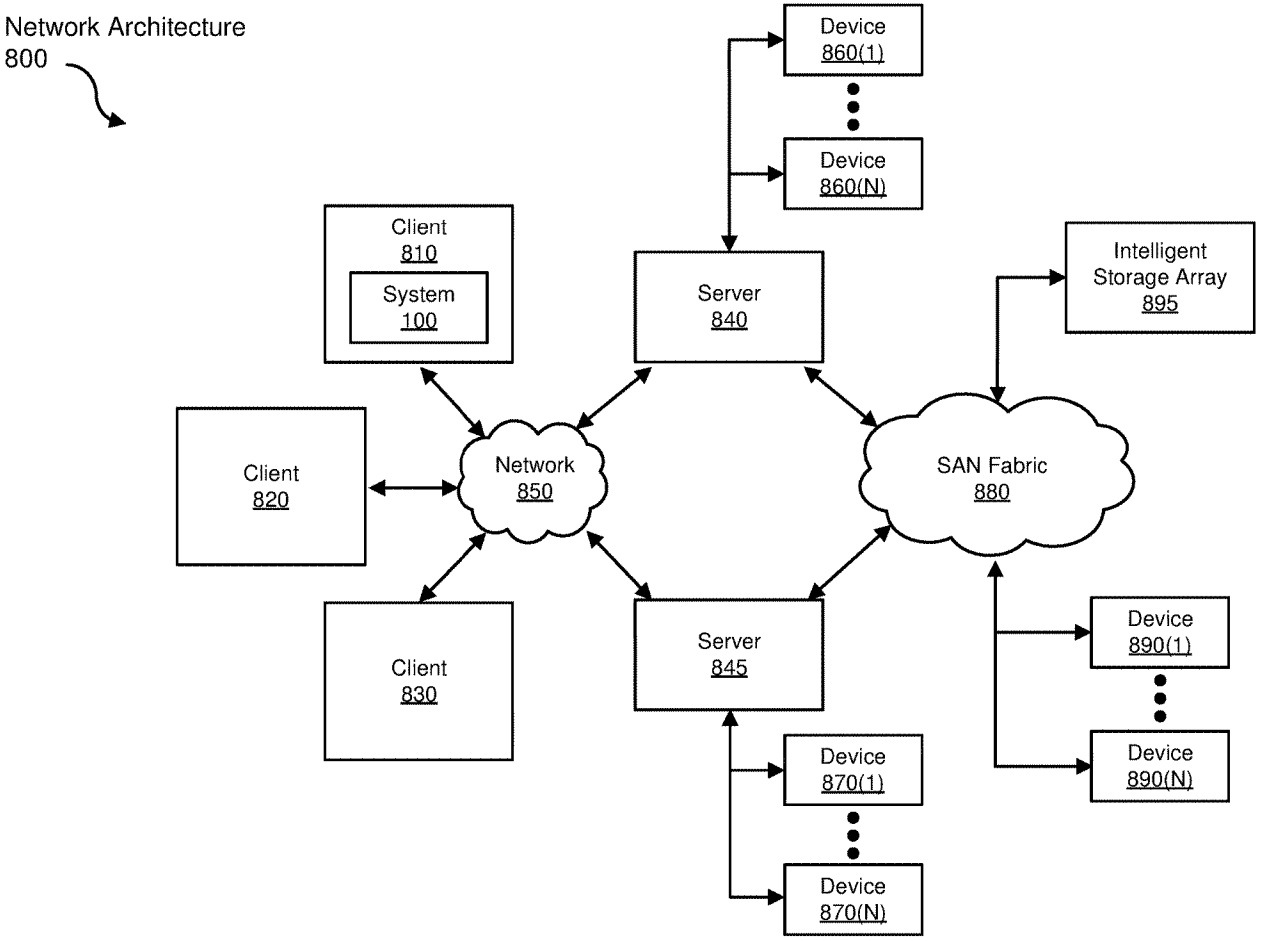
FIG. 8 is a block diagram of an example computing network capable of implementing one or more of the embodiments described and/or illustrated herein.

FIG. 8 is a block diagram of an example network architecture 800 in which client systems 810, 820, and 830 and servers 840 and 845 may be coupled to a network 850. As detailed above, all or a portion of network architecture 800 may perform and/or be a means for performing, either alone or in combination with other elements, one or more of the steps disclosed herein (such as one or more of the steps illustrated in FIG. 3). All or a portion of network architecture 800 may also be used to perform and/or be a means for performing other steps and features set forth in the instant disclosure.

Client systems 810, 820, and 830 generally represent any type or form of computing device or system, such as example computing system 710 in FIG. 7. Similarly, servers 840 and 845 generally represent computing devices or systems, such as application servers or database servers, configured to provide various database services and/or run certain software applications. Network 850 generally represents any telecommunication or computer network including, for example, an intranet, a WAN, a LAN, a PAN, or the Internet. In one example, client systems 810, 820, and/or 830 and/or servers 840 and/or 845 may include all or a portion of system 100 from FIG. 1.

As illustrated in FIG. 8, one or more storage devices 860(1)-(N) may be directly attached to server 840. Similarly, one or more storage devices 870(1)-(N) may be directly attached to server 845. Storage devices 860(1)-(N) and storage devices 870(1)-(N) generally represent any type or form of storage device or medium capable of storing data and/or other computer-readable instructions. In certain embodiments, storage devices 860(1)-(N) and storage devices 870(1)-(N) may represent Network-Attached Storage (NAS) devices configured to communicate with servers 840 and 845 using various protocols, such as Network File System (NFS), Server Message Block (SMB), or Common Internet File System (CIFS).

Servers 840 and 845 may also be connected to a Storage Area Network (SAN) fabric 880. SAN fabric 880 generally represents any type or form of computer network or architecture capable of facilitating communication between a plurality of storage devices. SAN fabric 880 may facilitate communication between servers 840 and 845 and a plurality of storage devices 890(1)-(N) and/or an intelligent storage array 895. SAN fabric 880 may also facilitate, via network 850 and servers 840 and 845, communication between client systems 810, 820, and 830 and storage devices 890(1)-(N) and/or intelligent storage array 895 in such a manner that devices 890(1)-(N) and array 895 appear as locally attached devices to client systems 810, 820, and 830. As with storage devices 860(1)-(N) and storage devices 870(1)-(N), storage devices 890(1)-(N) and intelligent storage array 895 generally represent any type or form of storage device or medium capable of storing data and/or other computer-readable instructions.

In certain embodiments, and with reference to example computing system 710 of FIG. 7, a communication interface, such as communication interface 722 in FIG. 7, may be used to provide connectivity between each client system 810, 820, and 830 and network 850. Client systems 810, 820, and 830 may be able to access information on server 840 or 845 using, for example, a web browser or other client software. Such software may allow client systems 810, 820, and 830 to access data hosted by server 840, server 845, storage devices 860(1)-(N), storage devices 870(1)-(N), storage devices 890(1)-(N), or intelligent storage array 895. Although FIG. 8 depicts the use of a network (such as the Internet) for exchanging data, the embodiments described and/or illustrated herein are not limited to the Internet or any particular network-based environment.

In at least one embodiment, all or a portion of one or more of the example embodiments disclosed herein may be encoded as a computer program and loaded onto and executed by server 840, server 845, storage devices 860(1)-(N), storage devices 870(1)-(N), storage devices 890(1)-(N), intelligent storage array 895, or any combination thereof. All or a portion of one or more of the example embodiments disclosed herein may also be encoded as a computer program, stored in server 840, run by server 845, and distributed to client systems 810, 820, and 830 over network 850.

As detailed above, computing system 710 and/or one or more components of network architecture 800 may perform and/or be a means for performing, either alone or in combination with other elements, one or more steps of an example method for providing assistance to users in emergency situations.

While the foregoing disclosure sets forth various embodiments using specific block diagrams, flowcharts, and examples, each block diagram component, flowchart step, operation, and/or component described and/or illustrated herein may be implemented, individually and/or collectively, using a wide range of hardware, software, or firmware (or any combination thereof) configurations. In addition, any disclosure of components contained within other components should be considered example in nature since many other architectures can be implemented to achieve the same functionality.

In some examples, all or a portion of example system 100 in FIG. 1 may represent portions of a cloud-computing or network-based environment. Cloud-computing environments may provide various services and applications via the Internet. These cloud-based services (e.g., software as a service, platform as a service, infrastructure as a service, etc.) may be accessible through a web browser or other remote interface. Various functions described herein may be provided through a remote desktop environment or any other cloud-based computing environment.

In various embodiments, all or a portion of example system 100 in FIG. 1 may facilitate multi-tenancy within a cloud-based computing environment. In other words, the software modules described herein may configure a computing system (e.g., a server) to facilitate multi-tenancy for one or more of the functions described herein. For example, one or more of the software modules described herein may program a server to enable two or more clients (e.g., customers) to share an application that is running on the server. A server programmed in this manner may share an application, operating system, processing system, and/or storage system among multiple customers (i.e., tenants). One or more of the modules described herein may also partition data and/or configuration information of a multi-tenant application for each customer such that one customer cannot access data and/or configuration information of another customer.

According to various embodiments, all or a portion of example system 100 in FIG. 1 may be implemented within a virtual environment. For example, the modules and/or data described herein may reside and/or execute within a virtual machine. As used herein, the term "virtual machine" generally refers to any operating system environment that is abstracted from computing hardware by a virtual machine manager (e.g., a hypervisor). Additionally or alternatively, the modules and/or data described herein may reside and/or execute within a virtualization layer. As used herein, the term "virtualization layer" generally refers to any data layer and/or application layer that overlays and/or is abstracted from an operating system environment. A virtualization layer may be managed by a software virtualization solution (e.g., a file system filter) that presents the virtualization layer as though it were part of an underlying base operating system. For example, a software virtualization solution may redirect calls that are initially directed to locations within a base file system and/or registry to locations within a virtualization layer.

In some examples, all or a portion of example system 100 in FIG. 1 may represent portions of a mobile computing environment. Mobile computing environments may be implemented by a wide range of mobile computing devices, including mobile phones, tablet computers, e-book readers, personal digital assistants, wearable computing devices (e.g., computing devices with a head-mounted display, smartwatches, etc.), and the like. In some examples, mobile computing environments may have one or more distinct features, including, for example, reliance on battery power, presenting only one foreground application at any given time, remote management features, touchscreen features, location and movement data (e.g., provided by Global Positioning Systems, gyroscopes, accelerometers, etc.), restricted platforms that restrict modifications to system-level configurations and/or that limit the ability of third-party software to inspect the behavior of other applications, controls to restrict the installation of applications (e.g., to only originate from approved application stores), etc. Various functions described herein may be provided for a mobile computing environment and/or may interact with a mobile computing environment.

In addition, all or a portion of example system 100 in FIG. 1 may represent portions of, interact with, consume data produced by, and/or produce data consumed by one or more systems for information management. As used herein, the term "information management" may refer to the protection, organization, and/or storage of data. Examples of systems for information management may include, without limitation, storage systems, backup systems, archival systems, replication systems, high availability systems, data search systems, virtualization systems, and the like.

In some embodiments, all or a portion of example system 100 in FIG. 1 may represent portions of, produce data protected by, and/or communicate with one or more systems for information security. As used herein, the term "information security" may refer to the control of access to protected data. Examples of systems for information security may include, without limitation, systems providing managed security services, data loss prevention systems, identity authentication systems, access control systems, encryption systems, policy compliance systems, intrusion detection and prevention systems, electronic discovery systems, and the like.

According to some examples, all or a portion of example system 100 in FIG. 1 may represent portions of, communicate with, and/or receive protection from one or more systems for endpoint security. As used herein, the term "endpoint security" may refer to the protection of endpoint systems from unauthorized and/or illegitimate use, access, and/or control. Examples of systems for endpoint protection may include, without limitation, anti-malware systems, user authentication systems, encryption systems, privacy systems, spam-filtering services, and the like.

The process parameters and sequence of steps described and/or illustrated herein are given by way of example only and can be varied as desired. For example, while the steps illustrated and/or described herein may be shown or discussed in a particular order, these steps do not necessarily need to be performed in the order illustrated or discussed. The various example methods described and/or illustrated herein may also omit one or more of the steps described or illustrated herein or include additional steps in addition to those disclosed.

While various embodiments have been described and/or illustrated herein in the context of fully functional computing systems, one or more of these example embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may configure a computing system to perform one or more of the example embodiments disclosed herein.

In addition, one or more of the modules described herein may transform data, physical devices, and/or representations of physical devices from one form to another. For example, one or more of the modules recited herein may receive information about a user involved in an emergency situation to be transformed, transform the information into an indication of an individual qualified to assist the user, output a result of the transformation to the individual and the user, use the result of the transformation to enable the individual to assist the user, and store the result of the transformation in a server or database. Additionally or alternatively, one or more of the modules recited herein may transform a processor, volatile memory, non-volatile memory, and/or any other portion of a physical computing device from one form to another by executing on the computing device, storing data on the computing device, and/or otherwise interacting with the computing device.

The preceding description has been provided to enable others skilled in the art to best utilize various aspects of the example embodiments disclosed herein. This example description is not intended to be exhaustive or to be limited to any precise form disclosed. Many modifications and variations are possible without departing from the spirit and scope of the instant disclosure. The embodiments disclosed herein should be considered in all respects illustrative and not restrictive. Reference should be made to the appended claims and their equivalents in determining the scope of the instant disclosure.

Unless otherwise noted, the terms "connected to" and "coupled to" (and their derivatives), as used in the specification and claims, are to be construed as permitting both direct and indirect (i.e., via other elements or components) connection. In addition, the terms "a" or "an," as used in the specification and claims, are to be construed as meaning "at least one of." Finally, for ease of use, the terms "including" and "having" (and their derivatives), as used in the specification and claims, are interchangeable with and have the same meaning as the word "comprising."

What is claimed is:

1. A computer-implemented method for providing assistance to users in emergency situations, at least a portion of the method being performed by an endpoint device comprising at least one processor, the method comprising:

detecting that a user of the endpoint device is involved in an emergency situation;

before requesting assistance for the user from an emergency response agency, identifying an individual that is nearby the user and is capable of assisting the user in the emergency situation by:

locating an additional endpoint device that is nearby the endpoint device of the user;

receiving, from the additional endpoint device, a message that asserts an attribute of the individual that indicates the individual is qualified to assist the user involved in the emergency situation; and determining, by the endpoint device, that the attribute has been verified by a trusted third party;

determining, based on the individual being capable of assisting the user in the emergency situation, to request assistance for the user from the individual instead of the emergency response agency; and in response to determining to request assistance for the user from the individual instead of the emergency response agency, enabling the individual to assist the user involved in the emergency situation by providing information about the emergency situation from the endpoint device of the user to the additional endpoint device.

2. The method of claim 1, wherein detecting that the user of the endpoint device is involved in the emergency situation comprises determining that the user is experiencing a medical emergency based on biological sensors within the endpoint device that monitor a health level of the user.

3. The method of claim 1, wherein identifying the individual that is nearby the user and is capable of assisting the user in the emergency situation comprises:

identifying a plurality of individuals that are nearby the user and are capable of assisting the user in the emergency situation; and selecting an individual most qualified to assist the user in the emergency situation based on a comparison between attributes of the plurality of individuals that indicate the individuals are qualified to assist the user.

4. The method of claim 1, wherein identifying the individual that is nearby the user and is capable of assisting the user in the emergency situation comprises:

broadcasting a request for assistance to all endpoint devices nearby the endpoint device of the user; and receiving, from the additional endpoint device in response to the request, the attribute of the individual that indicates the individual is qualified to assist the user.

5. The method of claim 1, wherein identifying the individual that is nearby the user and is capable of assisting the user in the emergency situation comprises determining that the additional endpoint device broadcasts the attribute of the individual prior to receiving a communication from the endpoint device of the user.

6. The method of claim 1, wherein locating the additional endpoint device that is nearby the endpoint device of the user comprises at least one of:

determining that the additional endpoint device is located within a predetermined geographic distance from the endpoint device of the user; and identifying the additional endpoint device using a short-range communication protocol.

7. The method of claim 1, wherein providing the information about the emergency situation from the endpoint device of the user to the additional endpoint device comprises establishing a secure connection between the endpoint device of the user and the additional endpoint device using a public key of the individual capable of assisting the user in the emergency situation.

8. The method of claim 7, wherein the additional endpoint device distributes the public key of the individual to the endpoint device of the user alongside the attribute of the individual.

9. The method of claim 1, wherein the attribute of the individual comprises at least one of:

an educational degree of the user;

a certification of the user; and an occupation of the user.

10. The method of claim 1, further comprising:

detecting that the user of the endpoint device is involved in an additional emergency situation;

determining that no individual capable of assisting the user in the emergency situation is currently nearby the user; and alerting the emergency response agency about the emergency situation in response to determining that no individual is currently capable of assisting the user in the emergency situation.

11. A system for providing assistance to users in emergency situations, the system comprising:

a detection module, stored in memory, that detects that a user of an endpoint device is involved in an emergency situation;

an identification module, stored in memory, that identifies, before assistance for the user is requested from an emergency response agency, an individual that is nearby the user and is capable of assisting the user in the emergency situation by:

locating an additional endpoint device that is nearby the endpoint device of the user;

receiving, from the additional endpoint device, a message that asserts an attribute of the individual that indicates the individual is qualified to assist the user involved in the emergency situation;

determining, on the endpoint device, that the attribute has been verified by a trusted third party; and determining, based on the individual being capable of assisting the user in the emergency situation, to request assistance for the user from the individual instead of the emergency response agency;

an information module, stored in memory, that enables, in response to the determination to request assistance for the user from the individual instead of the emergency response agency, the individual to assist the user involved in the emergency situation by providing information about the emergency situation from the endpoint device of the user to the additional endpoint device; and at least one physical processor configured to execute the detection module, the identification module, and the information module.

12. The system of claim 11, wherein the detection module detects that the user of the endpoint device is involved in the emergency situation by determining that the user is experiencing a medical emergency based on biological sensors within the endpoint device that monitor a health level of the user.

13. The system of claim 11, wherein the identification module identifies the individual that is nearby the user and is capable of assisting the user in the emergency situation by:

identifying a plurality of individuals that are nearby the user and are capable of assisting the user in the emergency situation; and selecting an individual most qualified to assist the user in the emergency situation based on a comparison between attributes of the plurality of individuals that indicate the individuals are qualified to assist the user.

14. The system of claim 11, wherein the identification module identifies the individual that is nearby the user and is capable of assisting the user in the emergency situation by:

broadcasting a request for assistance to all endpoint devices nearby the endpoint device of the user; and receiving, from the additional endpoint device in response to the request, the attribute of the individual that indicates the individual is qualified to assist the user.

15. The system of claim 11, wherein the identification module identifies the individual that is nearby the user and is capable of assisting the user in the emergency situation by determining that the additional endpoint device broadcasts the attribute of the individual prior to receiving a communication from the endpoint device of the user.

16. The system of claim 11, wherein the identification module locates the additional endpoint device that is nearby the endpoint device of the user by at least one of:

determining that the additional endpoint device is located within a predetermined geographic distance from the endpoint device of the user; and identifying the additional endpoint device using a short-range communication protocol.

17. The system of claim 11, wherein the information module provides the information about the emergency situation from the endpoint device of the user to the additional endpoint device by establishing a secure connection between the endpoint device of the user and the additional endpoint device using a public key of the individual capable of assisting the user in the emergency situation.

18. The system of claim 17, wherein the additional endpoint device distributes the public key of the individual to the endpoint device of the user alongside the attribute of the individual.

19. The system of claim 11, wherein the attribute of the individual comprises at least one of:

an educational degree of the user;

a certification of the user; and an occupation of the user.

20. A non-transitory computer-readable medium comprising one or more computer-executable instructions that, when executed by an endpoint device comprising at least one processor, cause the endpoint device to:

detect that a user of the endpoint device is involved in an emergency situation;

before requesting assistance for the user from an emergency response agency, identify an individual that is nearby the user and is capable of assisting the user in the emergency situation by:

locating an additional endpoint device that is nearby the endpoint device of the user;

receiving, from the additional endpoint device, a message that asserts an attribute of the individual that indicates the individual is qualified to assist the user involved in the emergency situation; and determining, by the endpoint device, that the attribute has been verified by a trusted third party;

determine, based on the individual being capable of assisting the user in the emergency situation, to request assistance for the user from the individual instead of the emergency response agency; and in response to determining to request assistance for the user from the individual instead of the emergency response agency, enable the individual to assist the user involved in the emergency situation by providing information about the emergency situation from the endpoint device of the user to the additional endpoint device.

* * * * *